United States Patent [19]

Lagushenko et al.

[11] Patent Number: 4,884,007

[45] Date of Patent: Nov. 28, 1989

[54] LOW PRESSURE ARC DISCHARGE TUBE HAVING INCREASED VOLTAGE

[75] Inventors: Radomir Lagushenko; Jakob Maya, both of Brookline, Mass.

[73] Assignee: GTE Products Corporation, Danvers, Mass.

[21] Appl. No.: 285,370

[22] Filed: Dec. 15, 1988

Related U.S. Application Data

[63] Continuation of Ser. No. 678,958, Dec. 6, 1984, abandoned.

[51] Int. Cl.[4] ..... H01J 61/30

[52] U.S. Cl. ..... 313/573; 313/610; 313/634

[58] Field of Search ..... 313/573, 609, 610, 611, 313/634

[56] References Cited

U.S. PATENT DOCUMENTS

| | | | |
|---|---|---|---|
| 2,298,239 | 10/1942 | Stirnkorb | 313/611 |
| 2,363,070 | 11/1944 | Lemmers | 176/122 |
| 3,531,687 | 9/1970 | Greber | 315/309 |
| 3,848,150 | 11/1974 | Taxil et al. | 313/610 X |

FOREIGN PATENT DOCUMENTS

| | | |
|---|---|---|
| 912243 | 4/1954 | Fed. Rep. of Germany . |
| 1162139 | 9/1958 | France . |

*Primary Examiner*—Kenneth Wieder

*Attorney, Agent, or Firm*—Carlo S. Bessone

[57] ABSTRACT

A low pressure arc discharge tube having structural means located within the envelope for raising the voltage across the arc tube. The structural means comprises at least one partition extending across the arc tube and having a dimension which is less than the electron energy relaxation distance of the arc discharge tube. Each of the partitions has at least one aperture therein which constricts the arc within the tube.

13 Claims, 2 Drawing Sheets

LOW PRESSURE ARC DISCHARGE TUBE HAVING INCREASED VOLTAGE

This application is a continuation of application Ser. No. 678,958, filed Dec. 6, 1984, now abandoned.

CROSS-REFERENCE TO RELATED APPLICATIONS

This application discloses subject matter related to that in U.S. Ser. Nos. 678,959, 678,928; 678,929; U.S. Pat. No. 4,585,468; and U.S. Pat. No. 4,582,523, filed concurrently herewith, and assigned to the Assignee of this Application, but does not claim the inventions claimed in such related Applications.

BACKGROUND

This invention relates to low pressure arc discharge tubes and more particularly to such tubes having an increased voltage drop thereacross.

It is often desirable to have a higher voltage drop across an arc discharge tube. For example, in ballastless discharge lamps it is desirable to raise the voltage across the lamp to equal the line voltage (110 volts in the U.S.; 220 volts in Europe) in order to minimize other circuit losses.

In low power, i.e. 40 W, metal halide discharge lamps it is desirable to operate at about 50 volts across the lamps to maintain stability (approx. 50–60 volts across the ballast). This higher voltage can be obtained by raising the mercury pressure. However, this increases the probability of explosions. Therefore, it is desirable to raise the voltage without increasing the pressure.

It is known in the art that the voltage across an arc discharge tube can be increased by varying the operating parameters of the discharge tube, such as the pressure; the current; the cathode fall; etc. However, altering these parameters effects the performance or some other aspect of the discharge tube.

BRIEF SUMMARY OF THE DISCLOSURE

It is therefore, an object of this invention to obviate the disadvantages of the prior art.

It is another object of the invention to provide an arc discharge tube having an increased voltage drop thereacross.

These objects are accomplished, in one aspect of the invention, by the provision of a low pressure arc discharge tube having an envelope of elongate, substantially cylindrical shape and having an electrode located at each end of the envelope. The envelope encloses an inert starting gas and a quantity of mercury. Included within the envelope are structural means for raising the voltage across the arc tube.

Incorporation of the last-mentioned structural means allows the arc tube to have increased voltage thereacross without changing any of the operational parameters such as the pressure, current, cathode fall, etc.

DETAILED DESCRIPTION OF THE PREFERRED EMBODIMENTS

For a better understanding of the present invention, together with other and further objects, advantages, and capabilities thereof, reference is made to the following disclosure and appended claims taken in conjunction with the above-described drawings.

Figure 1:
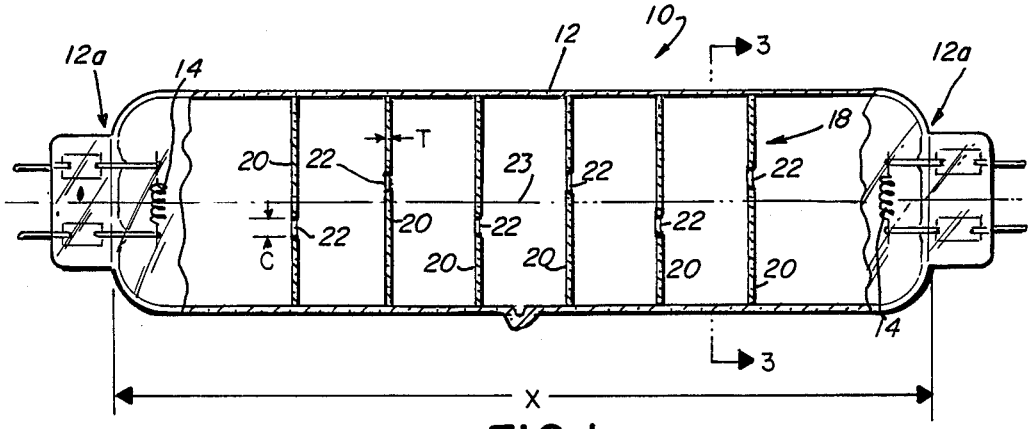
FIG. 1 is an elevational view, partly broken away, of an embodiment of the invention.
Figure 2:
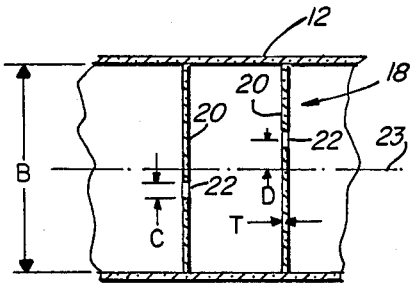
FIG. 2 is a partial cross-sectional view of FIG. 1.
Figure 3:
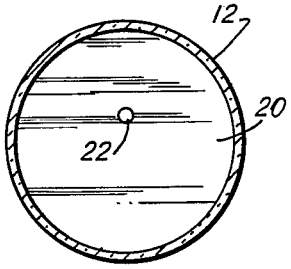
FIG. 3 is a cross-sectional view as taken along the line 3—3 in FIG. 1.

Referring now to the drawings with greater particularly, FIG. 1 shows an arc discharge tube 10 according to a preferred embodiment of the invention. The arc discharge tube 10 includes an envelope 12 of substantially cylindrical shape which is generally made of light-transmitting soda-lime, lead, quartz or other suitable material. An electrode 14 is located within each of the two axially opposed end portions 12*a* of the envelope. The envelope 12 encloses an ionizable medium including a quantity of mercury and an inert starting gas, e.g. neon at a low pressure in the range of about 0.5 to 4 torr. Structural means 18 of quartz, glass, ceramic or other suitable electrically insulating material for raising the voltage across the arc discharge tube 10 are incorporated within envelope 12. As shown in FIGS. 1–3 structural means 18 comprise a plurality of axially spaced apart partitions 20 each having at least one aperture 22 therein. Each of the partitions extends across the envelope 12 substantially normal to the longitudinal axis 23 and has a thickness T.

For best results T has a dimension less than the electron energy relaxation distance $d_r$ of the discharge tube. The electron energy relaxation distance is defined by the equation:

$$d_r^{-1}=[(3P_{Hg}Q_{in}^{Hg}+3P_RQ_{in}^R)(P_{Hg}Q^{Hg}+P_RQ^R)]^{\frac{1}{2}}$$

where $P_{Hg}$ is the mercury number density in the vapor $P_R$ is the rare gas number density $Q_{in}^{Hg}$ is the total inelastic scattering cross-section for the electrons by Hg.

$Q_{in}^R$ is the total inelastic scattering cross-section for the electrons by gas $Q^{Hg}$ is the total scattering cross-section for electrons by Hg.

$Q^R$ is the total scattering cross-section for electrons by gas.

Each of the partitions 20 contains at least one aperture 22 which constricts the arc within the tube and causes an increase in the voltage across the arc discharge tube. Aperture 22 having a diameter C can be located at the center of the partition 20 or eccentrically located in the partition as in FIGS. 1–3. Locating the aperture 22 remote from the center of the partition, and having the apertures 22 of adjacent partitions 20 positioned in non-alignment provides the added advantage of increasing the effective arc length of the tube. The maximum effective arc length is achieved if the apertures 22 are also located alternatingly about the longitudinal axis of the arc tube and if the apertures intersect a common plane passing through the longitudinal axis.

The partitions 20 may be sealed hermetically to the interior surface of envelope 12. However, an hermetic seal is unnecessary if the total area between the perimeter of each partition and the interior surface of the envelope is less than the area of aperture 22. The forming of the end portions 12*a* and the sealing of the electrode 14 leadwires can be performed after the partitions 20 are installed.

Table 1 shows the electrical parameters obtained from the four above mentioned arc tubes. Arc tubes 10, 10″ and 10‴ were made according to the invention while arc tube 10′ denotes the reference control tube.

TABLE I

| TUBE NUMBER | FIGURE NUMBER | NUMBER OF PARTITIONS | VOLTS | AMPS | WATTS | Hg PRESSURE (m torr) |
|---|---|---|---|---|---|---|
| 10 | 1 | 6 | 75 | 1.0 | 56 | 12.0 |
| 10′ | 4 | 0 | 39 | 1.0 | | 12.0 |
| 10″ | 5 | 2 | 42 | 1.0 | 41 | 4.0 |
| 10‴ | 6 | 1 | 31 | 1.0 | | 4.0 |
| 10″ | 5 | 2 | 45 | 0.5 | 20 | 15.0 |
| 10‴ | 6 | 1 | 37 | 0.5 | 15 | 15.0 |

The voltage developed by each partition 20 is inversely proportional to the size of the aperture 22. An increase in voltage can be achieved when the ratio of the internal diameter B of the envelope 12 to the aperture 22 diameter C is as small as approximately 1.1:1. For maximum voltage increase, the aperture 22 diameter C should be made small enough to achieve a ratio B:C of approximately 50:1. Voltage increases of from about 0.5 volts to about 20 volts per partition can be achieved depending on the ratio B:C.

The invention will now be described more fully with reference to examples and to the drawings in FIGS. 1–6.

Four arc discharge tubes were constructed from quartz all having an envelope 12 wall thickness of about 1 mm, a length X equal to about 90 mm and an outside diameter of about 25 mm. Each arc tube contained a fill gas of 100 percent neon at a pressure of about 2.0 torr.

The arc tube 10 of FIG. 1 was made with six apertured quartz partitions 20, each having a thickness T equal to about 1 mm. The partitions 20 were equally spaced apart from each other by about 10 mm. The distance from either electrode 14 to an adjacent partition 20 was also about 10 mm.

Each of the six partitions 20 had an aperture 22 diameter C of about 0.5 mm. This results in a ratio B:C of 46:1. The apertures 22 were located alternating about the longitudinal axis of the arc tube 10. The distance D from the longitudinal axis to the midpoint of each aperture was about 2 mm. The apertures also intersect a common plane passing through the longitudinal axis of the arc tube (e.g., the plane of the drawing of FIG. 1).

Figure 4:
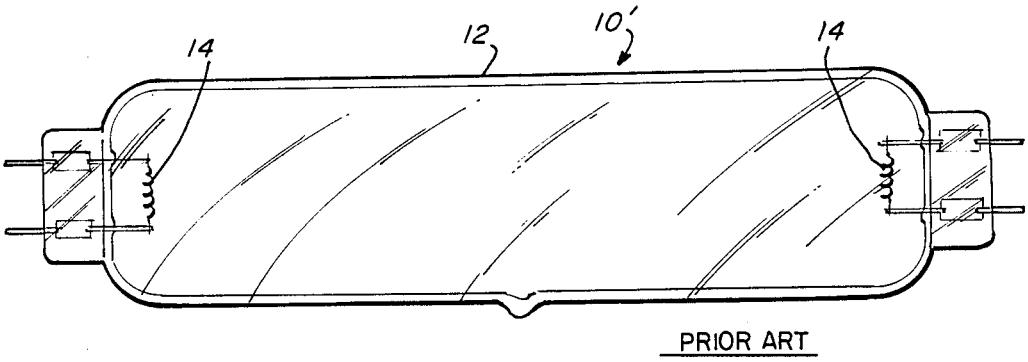
FIG. 4 is an elevational view of a prior-art type arc discharge tube used as a control or reference in testing embodiments of the invention.

FIG. 4 shows a reference or control tube 10′ constructed without the apertured partitions.

Figure 5:
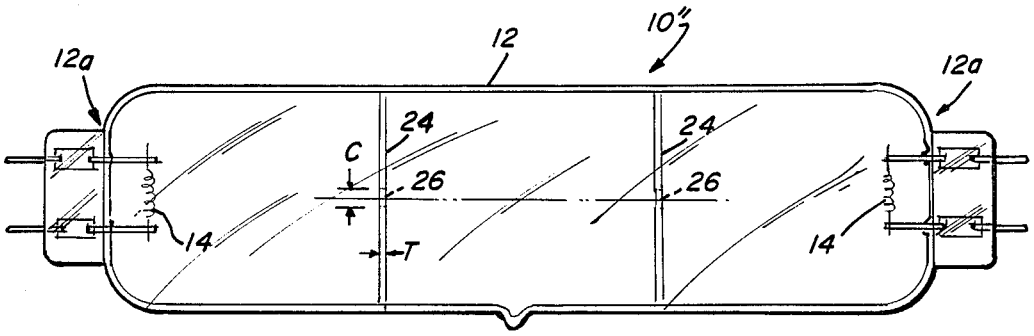
FIG. 5 is an elevational view of another embodiment of the invention.

FIG. 5 shows an arc tube 10″ according to another embodiment of the invention containing two apertured quartz partitions 24, each having a thickness T equal to about 1 mm. The two partitions were spaced apart from each other by about 25 mm. The distance from either electrode 14 to an adjacent partition 24 was about 20 mm. The two partitions 24 had an aperture 26 having a diameter C of about 2 mm and located coaxially at about the midpoint of the partition. This results in a ratio B:C of 11.5:1.

Figure 6:
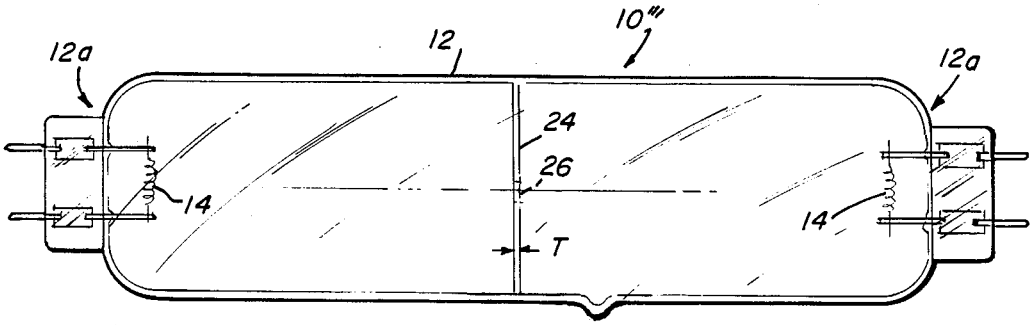
FIG. 6 is an elevational view of yet another embodiment of the invention.

FIG. 6 shows an arc tube 10‴ made in accordance with yet another invention and having a single quartz partition 24 located at approximately the center the tube. The partition 24 had a thickness T equal of about 1 mm.

This partition 24, which was similar to those used in FIG. 5, had an aperture 26 with a diameter C of about 2 mm and was located coaxially at about the midpoint of the partition 24. The partition 24 of FIG. 6 was positioned at about the center of the arc tube envelope 12.

A comparison of arc tube 10 with the reference arc tube 10′ shows that at an arc current of 1.0 amp, the voltage across the arc tube has increased by about 92 percent. This is a voltage increase per partition of 6 volts.

A comparison of arc tubes 10″ and 10‴ shows an increase of 11 volts per partition at an arc current of 1.0 amp and an increase of 8 volts per partition at an arc current of 0.5 amp.

It is possible to obtain larger than 11 volts per partition as shown in Table I by further reduction in the fill gas pressure. As the pressure is reduced, the discharge at the area around the aperture in the partition becomes reddish which is characteristic of neon excitation. This was observed when about 16 volts was generated around the aperture. For aperture diameters less than about 0.1 mm, the voltage generated can be even greater.

The present invention is not limited to use in a glow discharge of mercury-inert gas without a phosphor layer. For example, use of partitions according to the invention in a 14″ T12 European fluorescent lamp could increase the voltage from 39 volts to 100 volts. This would cause the voltage across the ballast to drop from 180 volts to 120 volts and thereby reduce the ballast losses by 35%.

While there have been shown what are at present considered to be preferred embodiments of the invention, it will be apparent to those skilled in the art that various changes and modifications can be made herein without departing from the scope of the invention as defined by the appended claims.

We claim:

1. A low pressure arc discharge tube comprising:

an envelope having an elongated substantially cylindrical shape, said envelope having an internal diameter, a longitudinal axis and two axially opposed end portions;

first and second electrodes each located within a respective one of said axially opposed end portions;

an ionizable medium enclosed within said envelope including an inert starting gas and a quantity of mercury for producing a plasma discharge when a predetermined voltage is applied across said electrodes; and structural means located within said envelope including at least one partition having a predetermined thickness and extending substantially across said envelope in a direction substantially normal to said longitudinal axis of said envelope and having a single aperture with a given diameter located at the midpoint of said partition, the ratio of said internal diameter of said envelope to said aperture of said partition is within the range of from about 5:1 to 50:1, said structural means providing an increase in the voltage across said low pressure arc discharge tube without increasing the effective arc length of said tube.

2. The low pressure arc discharge tube of claim 1 wherein said ratio of said internal diameter to said aperture diameter is within the range of from about 11.5:1 to 50:1.

3. The low pressure arc discharge tube of claim 1 wherein said diameter of said aperture is less than or equal to about 2 millimeters.

4. The low pressure arc discharge tube of claim 1 wherein said diameter of said aperture is about 2 millimeters.

5. The low pressure arc discharge tube of claim 1 wherein said diameter of said aperture is about 1 millimeter.

6. The low pressure arc discharge tube of claim 1 wherein said diameter of said aperture is about 0.5 millimeter.

7. The low pressure arc discharge tube of claim 1 wherein said envelope has an internal diameter and the ratio of said internal diameter to said aperture diameter is within a range to provide increase of from about 6 volts to about 20 volts per partition.

8. The low pressure arc discharge tube of claim 1 wherein said structural means comprises a plurality of said apertured partitions axially spaced apart within said envelope.

9. A low pressure arc discharge tube comprising:

an envelope having an elongated substantially cylindrical shape, said envelope having a longitudinal axis and two axially opposed end portions;

first and second electrodes each located within a respective one of said axially opposed end portions;

an ionizable medium enclosed within said envelope including an inert starting gas and a quantity of mercury for producing a plasma discharge when a predetermined voltage is applied across said electrodes; and structural means located within said envelope including a plurality of partitions extending substantially across said envelope in a direction substantially normal to said longitudinal axis of said envelope, each of said partitions having a single aperture with a diameter less than or equal to about 2 millimeters located therein.

10. The low pressure arc discharge tube of claim 9 wherein each aperture is eccentrically located in its respective partition.

11. The low pressure arc discharge tube of claim 10 wherein the aperture of adjacent partitions are positioned in non-alignment.

12. The low pressure arc discharge tube of claim 11 wherein each of said apertures intersect a common plane passing through said longitudinal axis of said arc tube.

13. The low pressure arc discharge tube of claim 12 wherein said apertures are located alternatingly about said longitudinal axis of arc tube.

* * * * *